United States Patent [19]

Simpson, deceased

[11] Patent Number: 4,703,889

[45] Date of Patent: Nov. 3, 1987

[54] SPACE HEATING RADIATOR

[75] Inventor: Victor J. Simpson, deceased, late of Walton-on-Thames, England, by Jean Simpson, executrix

[73] Assignee: British Alcan Aluminium Limited, England

[21] Appl. No.: 819,139

[22] Filed: Jan. 15, 1986

[30] Foreign Application Priority Data

Jan. 17, 1985 [GB] United Kingdom ..... 8501160

[51] Int. Cl.[4] ..... F24H 3/00

[52] U.S. Cl. ..... 237/70; 165/128; 165/151

[58] Field of Search ..... 237/70, 50; 165/128, 165/168, 173, 175, 148, 151

[56] References Cited

U.S. PATENT DOCUMENTS 3,540,530 11/1970 Kritzer ..... 165/146

FOREIGN PATENT DOCUMENTS 67798 12/1982 European Pat. Off. ..... 237/70
2354843 11/1973 Fed. Rep. of Germany ..... 237/70
845144 4/1939 France ..... 237/70
1156142 5/1958 France ..... 237/70
2205655 11/1973 France ..... 237/70
2295395 11/1973 France ..... 237/70
WO82/04307 12/1982 PCT Int'l Appl. ..... 237/70
1045214 10/1966 United Kingdom ..... 237/70
1349157 3/1974 United Kingdom ..... 237/70
1349029 3/1974 United Kingdom ..... 237/70
1414908 11/1975 United Kingdom ..... 237/70
1538634 1/1979 United Kingdom ..... 237/70
2044910 10/1980 United Kingdom ..... 237/70
1594136 7/1981 United Kingdom ..... 237/70

*Primary Examiner*—Henry A. Bennet
*Attorney, Agent, or Firm*—Cooper, Dunham, Griffin & Moran

[57] ABSTRACT

A radiator comprising a plurality of longitudinally finned tubes formed from extruded aluminum and extending between upper and lower header pipes likewise of extruded aluminum. A water-tight joint is formed at the junction of each finned tube with the adjacent header by means of an interference fit nipple. The fins are shaped so as to define a gap between adjacent finned tubes through which air to be heated may be drawn. Such air enters a chamber defined between each adjacent pair of finned tubes and exits to the rear via louvers formed in the rear fins of the finned tubes, taking the general direction of arrows A. A degree of control of the heat output of the radiator may be achieved by rotation of a flap located at the bottom of the space between the radiator and the adjacent wall surface.

8 Claims, 5 Drawing Figures

SPACE HEATING RADIATOR

This invention relates to hot water radiators for use in space heating systems and is particularly directed to a design which can utilise aluminium to provide a lightweight and aesthetically attractive radiator.

Currently the most common form of aluminium radiator, and the one with which the present invention is concerned, comprises a plurality of finned tubes fabricated from extruded aluminium which are connected in parallel between respective upper and lower headers, a water-tight joint being formed at the junction of each tube with the respective header. European applications Nos. 0044365, 0067798, French patent specifications Nos. 2205655 and 2112275 and Swiss patent specification No. 601759 all describe similar constructions.

Another known type of radiator design, generally of earlier date and usually not intended to be fabricated in aluminium, seeks to provide an improved heating effect over conventional panel radiators by means of a box-like construction in which air to be heated is drawn into the box through apertures in the front of the box, passes from the front to the rear of the box (during which passage most of the heating effect takes place), and thence exits through further apertures in the rear of the box. British patent specifications No. 1045214 and 2044910, and French patent specifications Nos. 1156142 and 1389309 all describe constructions of this type. The present invention seeks to adapt this box-radiator type of construction to the current style of aluminium radiator construction, such as described above.

In accordance with the present invention there is provided a space heating radiator comprising a plurality of finned tubes fabricated from extruded aluminium, which tubes are connected in parallel between respective upper and lower headers, a water-tight joint being formed at the junction of each tube with the respective header, characterised in that each of the finned tubes is formed with at least two axially extending fins shaped to form a generally H-shaped cross section with the tube itself in the cross piece of the H and with one leg of the H longer than the other, the finned tubes being positioned along the headers such that the respective longer legs abut one another to form a rear wall leaving the shorter legs of adjacent finned tubes defining a gap therebetween at the front of the radiator, and wherein the longer legs of the H-section finned tubes are formed with apertures whereby air to be heated may be drawn in at the front through said gaps between adjacent finned tubes, and be expelled from the rear through said apertures in the longer legs of the finned tubes.

It is to be noted that, whilst existing radiators are orientated in use in such a way that the headers are horizontal and the finned tubes vertical, such orientation is not essential to the effective operation of the radiator of the present invention; however, such is the normal orientation and references herein to "upper" and "lower" headers are to be construed accordingly.

For use, the radiator is mounted on a wall such that a space exists at the rear. Air to be heated is drawn in through the gaps between adjacent finned tubes and exits through the apertures in the rear wall, taking a generally upward route as it does so. The heated air emerges into the aforementioned space at the rear of the heater and rises to heat the room. It will be seen that the effect of this is to create at the rear of the heater a body of air which is hotter, and therefore less dense, than the air at the front of the radiator. The resultant pressure differential causes a continuous suction action which draws air through the radiator in the manner described. This method of operation results in improved efficiency over conventional panel radiators since the whole heating surface is doing useful work. In the conventional panel radiator the boundary layer of air against the panel surface is heated as it rises up the surface. Thus the temperature differential as between the water within the radiator and the air in the boundary layer being heated falls the higher up the radiator surface the air rises. Near the top of the radiator the rate of emission of energy per unit of surface area is thus much reduced over an equivalent area near the bottom—about one third as much in an ordinary panel radiator. In the present radiator cold air is continuously drawn into the radiator through the gaps at the front between adjacent finned tubes so that the rate of heat transfer from the water is much more constant over the surface of the radiator. This leads to improved efficiency and hence a smaller size of radiator for an equivalent heat output.

The efficiency can be further enhanced by wholly or partially closing off the sides and bottom of the space at the rear of the heater to thereby stop cold air being drawn directly from behind the radiator. Such cold air would otherwise replace the warmed air which is rising from the rear of the radiator and reduce the amount of air drawn from the front to the rear of the radiator in the manner described above. Indeed, this enhancement effect can be used to provide a measure of regulation of the heat output from the radiator by providing a baffle at the bottom of the space behind the radiator which may be rotated to selectively open the bottom of the space at the rear of the radiator, and thereby vary the size of the opening to give intermediate heat settings. This is a much more effective way of regulating the radiator than attempting to turn down the radiator using the conventional radiator valve which is almost impossible due to the non-linear action of the latter.

The apertures in the rear wall can be provided in various ways. They may be formed as simple holes punched out of the metal of the fin, or the metal of the fin may be perforated to allow air flow therethrough. In the preferred embodiment, the apertures are provided as pressed-out louvres.

The finned tubes can take various forms. In one embodiment each H-section finned tube is formed with two T-section fins with the legs of the two T-sections extending from the tube itself in mutually opposite radial directions such that:

(a) the cross piece of the H-section comprises the tube itself together with the two legs of the T-section fins; and (b) each leg of the H-section comprises a respective top of one of the T-section fins, the top of one of the T-section fins being longer than the top of the other to thereby provide the unequal leg length of the H-section.

In a further embodiment each fin may be V-shaped or Y-shaped resulting in a concertina pattern rear wall.

Whatever the construction, it is necessary that a chamber or chambers be created within the radiator through which the air being heated flows as it passes from the front to the rear of the radiator. Within this chamber a certain amount of air turbulence occurs which ensures effective heat transfer from the tubes to the air. Heat transfer also takes place as the air passes through the apertures in the rear wall, particularly if these are formed as lattice perforations or louvres for example which will give a high rate of heat transfer to air passing through.

In order that the invention may be better understood, an embodiment thereof will now be described by way of example only and with reference to the accompanying drawings in which.

Figure 1:
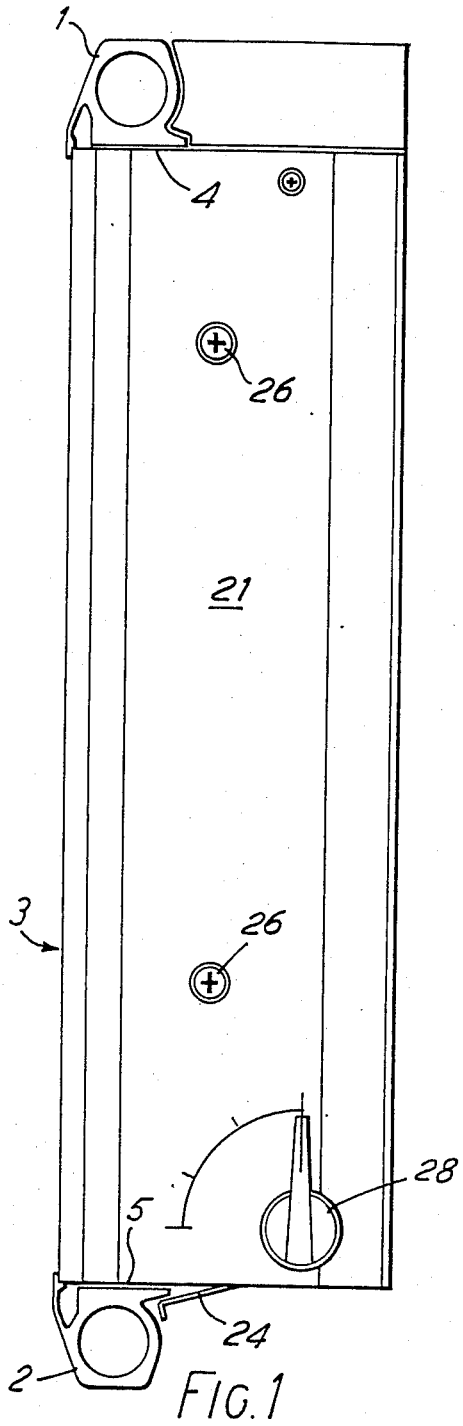
FIG. 1 is an end elevation of an embodiment of a radiator assembly according to the invention.
Figure 5:
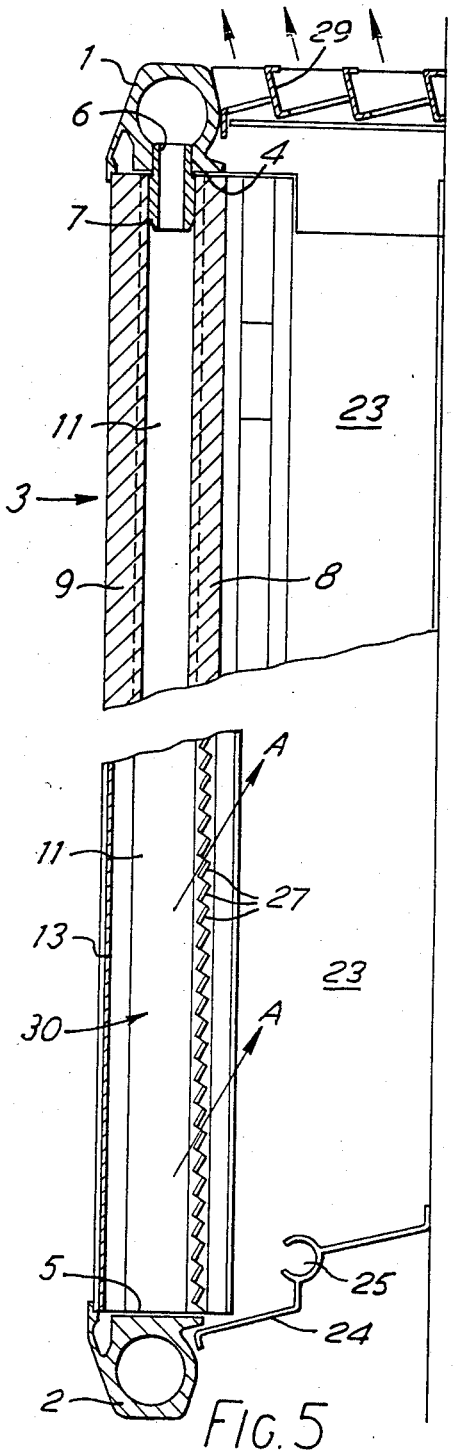
FIG. 5 is a section, in the upper part on lines A—A and in the lower part on lines B—B, of FIG. 4.
Figure 2:
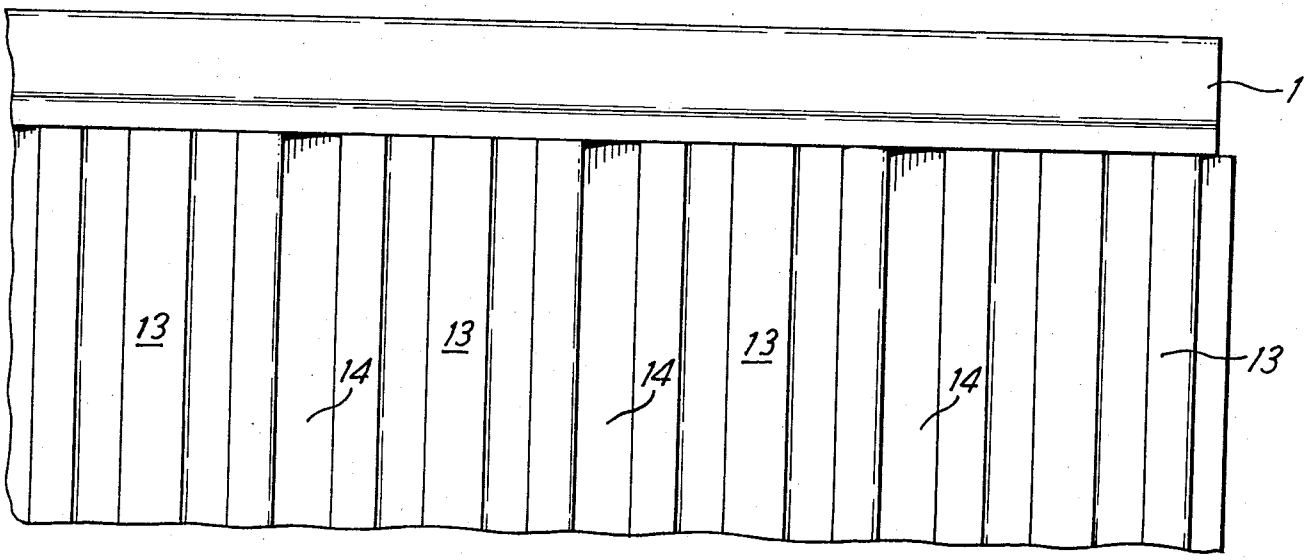
FIGS. 2 and 3 are partial front and plan views of the radiator assembly of FIG. 1.
Figure 3:
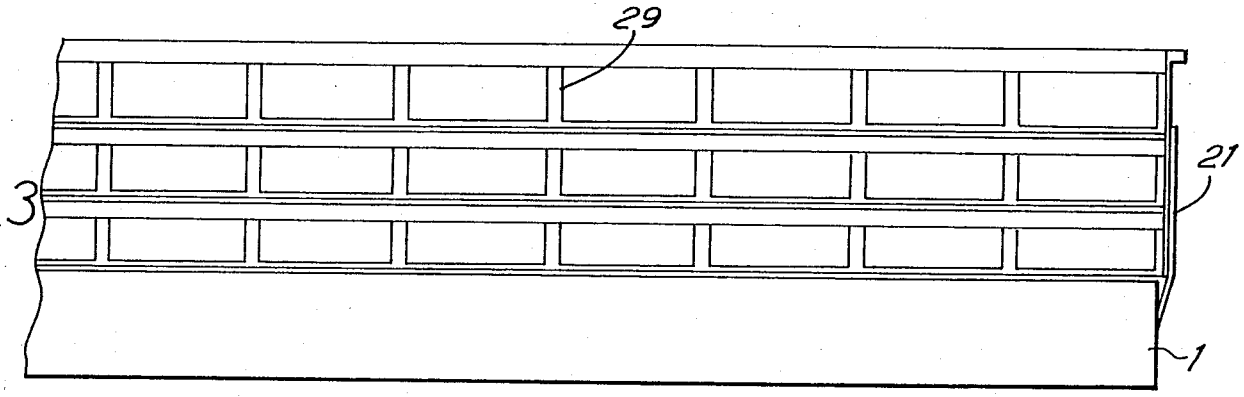

The radiator assembly comprises upper and lower header pipes 1,2 of extruded aluminium or aluminium alloy, which pipes are internally threaded at their ends for connection to suitable plumbing fittings (not shown). Between the header pipes extend a plurality of finned tubes 3 formed from extruded aluminium or aluminium alloy. For this purpose the facing surfaces 4,5 of the tubes 1,2 are made planar and parallel so that they may conveniently be butted up to the cut off ends of the tubes 3. The surfaces 4,5 are formed with a row of apertures 6 (FIG. 5) spaced to accord with the spacing of the tubes 3 and a water-tight and mechanically stable joint is effected at each junction by means of a cylindrical nipple 7 made of steel which is an interference fit into both the aperture 6 and the end of the corresponding tube 3. The whole radiator element is thus kept together as a rigid unit without the requirement for further components.

Each tube 3 is formed in the extrusion process with two longitudinal fins 8,9 arranged so that each finned tube is approximately H-shaped in section. The cross piece 10 of the finned tube carries the tube itself, shown under reference 11. One leg 12 of each H-section fin is a little longer than the other leg 13 in order to define a gap 14 between each adjacent pair of finned tubes when the tubes are in position with the ends of each leg 12 abutting adjacent legs 12, as shown clearly in FIG. 4. In addition each part of the leg 12 is provided with openings which are formed as louvres 27 pressed out of the metal of the fin after extrusion.

When all the finned tubes 3 are assembled between headers 1,2, the H-configuration of the tubes 3 results in a construction comprising a substantially continuous rear wall 15 made up of the butted fin legs 12. Between each adjacent pair of tubes a respective chamber 30 is defined. The gaps 14 appear from the front of the radiator as longitudinal openings extending parallel to the tubes 3—i.e. vertical when the radiator is in position for use.

The radiator is hung on a suitable wall 17 (FIG. 4) by means of conventional radiator brackets 18 screwed to the wall and onto which the radiator element is hung by a number of horizontal metal strips 19. Two such strips 19 are provided for each bracket, the outermost ends of the strips being extended at 20 to provide mounting for an end panel 21 as will be explained. The strips 19 are retained in place on the rear wall by lugs and locking screws in the manner shown. Intermediate strips 22, similar to strips 19, may be provided in the event that central support for the radiator element is required.

Note that, although the drawings show the radiator mounted such that the header tubes 1,2 are horizontal and the finned tubes 3 vertical, it is possible to hang the radiator in other orientations; in particular there may be advantage, particularly for long low radiators, in making the finned tubes long and the headers short and mounting the radiator such that the hearder tubes are vertical and the finned tubes horizontal. For such radiators, this form of mounting saves on joints and hence makes the radiator simpler and cheaper to construct.

Figure 4:
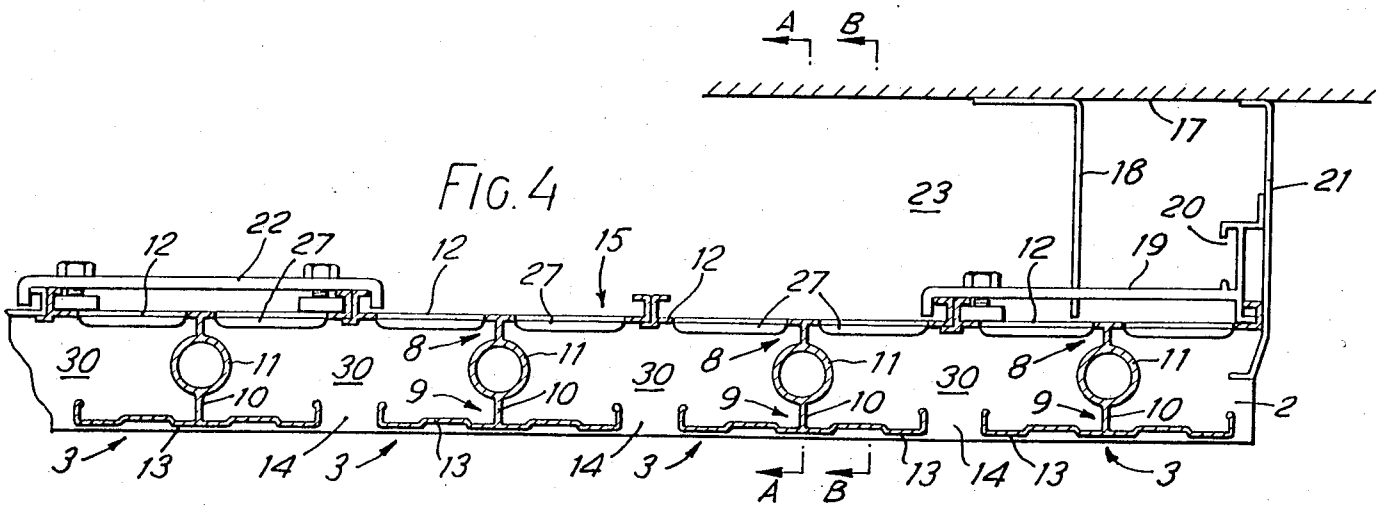
FIG. 4 is a partial horizontal section of the radiator assembly of FIG. 1.

The mounting of the radiator element on the wall leaves a space 23 at the rear of the radiator which is closed off at its sides by the aforesaid end panels 21—note that only one end panel is shown in FIG. 4. For this purpose the extended portions 20 of the clips 19 are shaped in such a way as to retain a captive nut (not shown) in order to retain the panels by means of screws 26. A rotatable flap or baffle 24 is rotatably mounted between the end panels about an axis 25 and serves to selectively close off the bottom of the space 23, as will be explained. A knob 28 is provided at one end for manual actuation of the baffle. If desired a grille 29 may be provided at the top of the sapce 23 in order to prevent objects falling behind the radiator element.

In use the radiator element is connected in the normal manner in the circuit of a heating system. Normal central heating systems are designed for a temperature differential of approximately 20° C. between the output and input water temperatures; in a system incorporating the above-described radiators, this differential can be reduced, for example to 10° C.

Cool air is drawn into the front of the radiator through the gaps 14 and into the chambers 30. Within these chambers a certain amount of turbulence takes place before the air exits through the louvres 27 in the rear wall, taking a generally upward course as it does so, as illustrated by the arrows A in FIG. 5. In passing from the front to the rear of the radiator element, the air is heated so that the air entering the space 23 at the rear of the element is less dense than that at the front. A suction action is thus created which acts to draw cool air towards the space 23 through the radiator element and, if the flap 24 is open, also from beneath the radiator. The high efficiency of the radiator results from the fact that the air being heated is subjected to the maximum temperature differential possible over the whole area of the radiator. If the flap 24 is open, thus allowing cool air to enter the space 23 from beneath and behind the radiator element, the amount of air entering the space 23 via the radiator element (and being heated thereby) is reduced and this in turn reduces efficiency since the effect of the rising boundary layer of air on the front face becomes more pronounced. If the flap is fully closed, all air entering the space 23 has to be drawn through the radiator element resulting in a plentiful supply of cool air entering the front face, and keeping the temperature of the rising boundary layer of air to a minimum. In these conditions, the efficiency of the radiator is at a maximum and its heat output is likewise at a maximum. It will be seen therefore that the flap 24 provides a means whereby the heat output of the radiator can be varied and this control has been found to be much more effective than control by means of radiator valves acting on the water supply. For the particular described radiator, movement of the flap from the fully closed to the fully open position results in an approximate halving of the heat output 25 from the radiator. Intermediate positions of the flap 24 result in a heat output which is intermediate between full and half.

The construction described also results in emission of a reasonable amount of radiant energy direct from the front surface of the legs 13 of fins 9.

The described radiator is capable of efficiencies well in excess of current aluminium radiators, particularly if used with the flap closed, and this results in a radiator which is smaller and thus lighter and cheaper than similar products. The front of the radiator presents an attractive aesthetic appearance which can be readily varied by altering the leg 13 portion of fin 9 to suit prevailing conditions or taste.

I claim:

1. A space heating radiator comprising a plurality of finned tubes fabricated from extruded aluminium which tubes are connected in parallel between respective upper and lower headers, a water-tight joint being formed at the junction of each tube with the respective header, characterised in that each of the finned tubes is formed with at least two axially extending fins shaped to form a generally H-shaped cross section with the tube itself in the cross piece of the H and with one leg of the H longer than the other, the finned tubes being positioned along the headers such that the respective longer legs abut one another to form a rear wall leaving the shorter legs of adjacent finned tubes defining a gap therebetween at the front of the radiator, and wherein the longer legs of the H-section finned tubes are formed with apertures whereby air to be heated may be drawn in at the front through said gaps between adjacent finned tubes, and be expelled from the rear through said apertures in the longer legs of the finned tubes.

2. A space heating radiator as claimed in claim 1 wherein the apertures in the longer legs of the finned tubes take the form of pressed out louvres.

3. A space heating radiator as claimed in claim 2 wherein the louvres extend in a direction parallel to the headers.

4. A space heating radiator as claimed in claim 1 wherein each H-section finned tube is formed with two T-section fins with the legs of the two T-sections extending from the tube itself in mutually opposite radial directions such that:

(a) the cross piece of the H-section comprises the tube itself together with the two legs of the T-section fins; and (b) each leg of the H-section comprises a respective top of one of the T-section fins, the top of one of the T-section fins being longer than the top of the other to thereby provide the unequal leg length of the H-section.

5. A space heating radiator as claimed in claim 4 wherein the leg of that T-section fin which forms part of the rear wall is shorter in length than the leg of the other T-section fin.

6. A space heating radiator as claimed in claim 1 wherein the H-section finned tubes are symmetrical about the cross piece of the H such that the gap defined between adjacent shorter legs of the H lies directly opposite the abutting joint between adjacent longer legs of the H.

7. A space heating radiator as claimed in claim 1 including wall mounting means for mounting the radiator in such a way that a space exists at the rear thereof, and wherein the sides and bottom of the space is wholly or partially closed off to prevent or reduce cold air being drawn directly up behind the radiator when in use.

8. A space heating radiator as claimed in claim 7 including an adjustable baffle at the bottom of the space at the rear of the radiator to allow air directly in to the rear of the radiator or not at choice.

* * * * *